US006228816B1

(12) United States Patent
Ito et al.

(10) Patent No.: US 6,228,816 B1
(45) Date of Patent: May 8, 2001

(54) AQUEOUS CUTTING FLUID, AQUEOUS CUTTING AGENT, AND PROCESS FOR CUTTING HARD BRITTLE MATERIALS WITH THE SAME

(75) Inventors: Kenji Ito; Shunji Maemichi, both of Aichi; Hutoshi Nakanishi, Yokohama; Masahiro Ishidoya, Chigasaki; Takashi Tanaka, Tokyo; Toshihiko Nakamichi, Fujisawa; Kazuyuki Mori, Aichi; Shigehiro Hayashi, Aichi; Hideki Yokoyama, Aichi, all of (JP)

(73) Assignees: NOF Corporation; Fujimi Incorporated, both of (JP)

( * ) Notice: Subject to any disclaimer, the term of this patent is extended or adjusted under 35 U.S.C. 154(b) by 0 days.

(21) Appl. No.: 09/380,706

(22) PCT Filed: Jan. 7, 1999

(86) PCT No.: PCT/JP99/00023

§ 371 Date: Oct. 6, 1999

§ 102(e) Date: Oct. 6, 1999

(87) PCT Pub. No.: WO99/35220

PCT Pub. Date: Jul. 15, 1999

(30) Foreign Application Priority Data

| | | |
|---|---|---|
| Jan. 9, 1998 | (JP) | 10-013488 |
| Apr. 10, 1998 | (JP) | 10-114412 |
| Nov. 10, 1998 | (JP) | 10-333373 |

(51) Int. Cl.[7] ..... C10M 173/02; C10M 125/26

(52) U.S. Cl. ..... 508/143; 508/136; 508/547; 72/42

(58) Field of Search ..... 508/143, 136

(56) References Cited

U.S. PATENT DOCUMENTS

| | | | | |
|---|---|---|---|---|
| 5,507,962 | * | 4/1996 | Jahanmir et al. | 252/49.3 |
| 5,663,111 | * | 9/1997 | Gadberry et al. | 501/146 |
| 5,693,596 | * | 12/1997 | Kaburagi et al. | 508/143 |
| 5,817,711 | * | 10/1998 | Kambe et al. | 524/501 |
| 5,859,124 | * | 1/1999 | Yorifuji et al. | 524/837 |

FOREIGN PATENT DOCUMENTS

| | | |
|---|---|---|
| 0686684 | 5/1995 | (EP) . |
| 1229803 | 4/1971 | (GB) . |
| 59-89395 | 5/1984 | (JP) . |
| 4-277598 | 10/1992 | (JP) . |

* cited by examiner

*Primary Examiner*—Ellen M. McAvoy
(74) *Attorney, Agent, or Firm*—Levy & Grandinetti

(57) ABSTRACT

An aqueous cutting liquid comprises a cationic water-soluble resin having an amine value of 20 to 200 mgKOH/g, and at least one rheology control agent selected from the group consisting of an inorganic bentonite, an organic bentonite and an aqueous silica sol, wherein the content of a nonvolatile matter of the rheology control agent is 0.1 to 30 percent by weight of the amount of the nonvolatile matter of the cationic water-soluble resin. An aqueous cutting agent comprises the aqueous cutting liquid, and an abrasive grain, wherein the content of the abrasive grain is 100 to 1000 percent by weight of the amount of the nonvolatile matter of the aqueous cutting liquid. A hard and brittle material is cut by a cutting device using the aqueous cutting agent. The present invention provides an aqueous cutting agent which is excellent in dispersion stability of the abrasive grain and viscosity stability during cutting/slicing operations, aqueous cutting liquid usable for the aqueous cutting agent, and a cutting/slicing method excellent in cutting performance, cleanability and the like of the work material on cutting/slicing hard and brittle material by using the cutting agent.

11 Claims, 1 Drawing Sheet

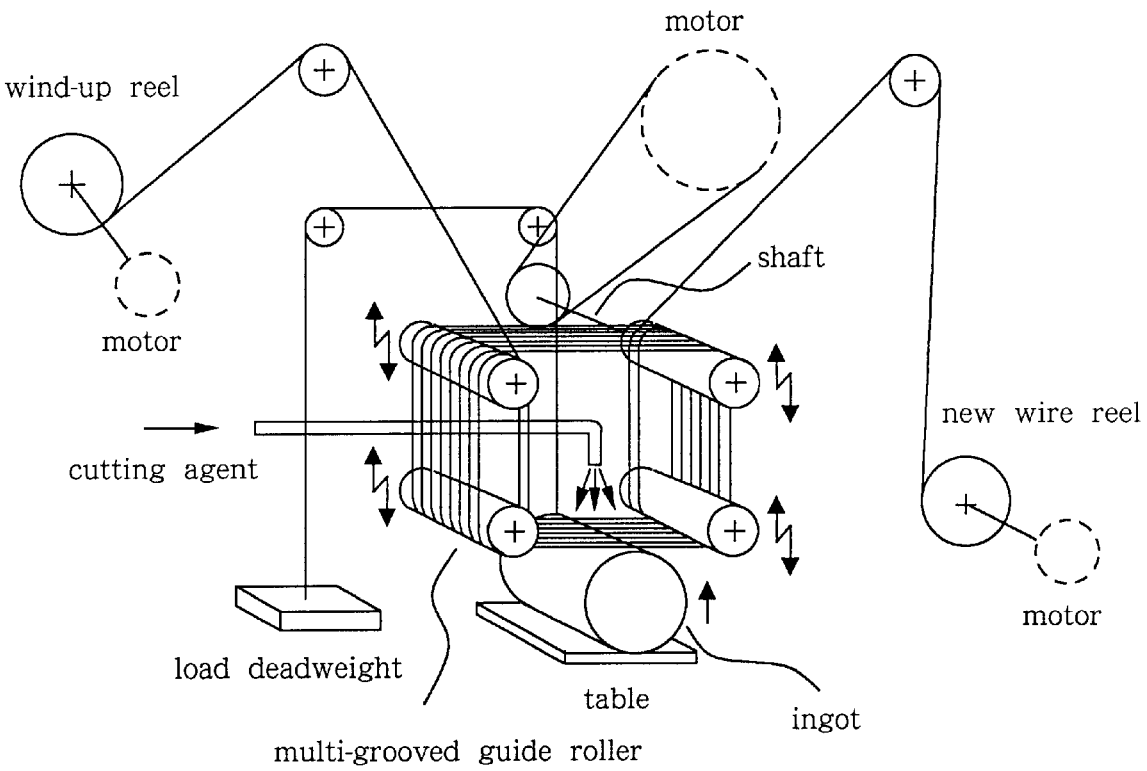
motor
wind-up reel
shaft
motor
new wire reel
cutting agent
motor
load deadweight
table
ingot
multi-grooved guide roller

AQUEOUS CUTTING FLUID, AQUEOUS CUTTING AGENT, AND PROCESS FOR CUTTING HARD BRITTLE MATERIALS WITH THE SAME

TECHNICAL FIELD

The present invention relates to an aqueous cutting agent, which can be used on precisely cutting/slicing work material made of a hard and brittle material such as an ingot of silicon single crystal or polycrystal, rock crystal, ceramic and glass, and an aqueous cutting liquid usable for the aqueous cutting agent, and a method for cutting the hard and brittle materials by using the aqueous cutting agent. More particularly, the present invention relates to an aqueous cutting agent, which is excellent in dispersion stability and viscosity stability of an abrasive grain and particularly effective for a wire sawing device, aqueous cutting liquid usable therefor, and a method for cutting/slicing hard and brittle materials, which is excellent in cutting performance, cleanability and the like of the work material.

BACKGROUND ART

Conventionally, in order to cut hard and brittle materials such as silicon single crystal, there has been used a cutting agent comprising an abrasive grain such as silicon carbide (SiC) dispersed in cutting liquid, and this cutting agent is supplied to a contact portion between a cutting device and work material to thereby obtain metal sheets of several tens to several thousands $\mu$m by slicing the work material thin.

Also, in the case of precision cutting using, for example, a multi-wire sawing device, the cutting is usually performed as follows: That is, in the multi-wire saw cutting device, wire is wound many times around a multi-grooved guide roller made of high molecular weight material, obtained by cutting with high precision to be reciprocated by a driving motor. This reciprocating wire is pressed against the work material while an adequate cutting load is being applied thereto to perform cutting by a cutting operation while the cutting agent is being supplied to the contact portion. Since the reciprocating wire is gradually worn as the work material is cut, the wire is wound up by a torque motor, and a new wire is supplied by a geared motor.

As the foregoing cutting agent, there have been used an oil cutting agent prepared by adding additives or the like to mineral oil as the base, a glycol cutting agent mainly composed of polyethylene glycol or polypropylene glycol, and an aqueous cutting agent mainly composed of an aqueous solution of a surface-active agent.

However, the conventional oil base cutting agents had the following problem: That is, the cutting agents mainly composed of mineral oil have the advantages that they are excellent in lubricating properties, and have good cut surface of the work material, and good cutting performance, but are inferior in cooling performance. Therefore, the conventional oil base cutting agents had the problem that the operating efficiency is decreased because the temperature at a contact portion increases during an operation to generate oil mist, an operator gets burned in a dismantling operation for the work material after the termination of a cutting operation, or a fire can also occur.

Also, when the work material, the operator and equipment have been contaminated by the cutting agents, an organic solvent cleaning fluid such as trichloroethane, methylene chloride or the like is required to remove the pollution. Since, however, the organic solvent cleaning fluid causes carcinogenesis or air pollution, there has also been the problem of waste treatment that it cannot be scrapped unless some disposal is performed for the cleaning discharge.

Also, in order to solve such conventional problems on the oil base cutting agent, the aqueous cutting agent mainly composed of the foregoing glycol cutting agent or aqueous solution of a surface-active agent has also been studied, but the viscosity stability during cutting was not sufficient, good cutting performance could not be obtained, and it was inferior in dispersion stability of the abrasive grain, and it could not be sufficiently satisfied.

DISCLOSURE OF INVENTION

It is an object of the present invention to provide an aqueous cutting agent which is excellent in dispersion stability (properties in which the abrasive grain settle down and do not make any hard cake, but are easily re-dispersed by simple agitation) of the abrasive grain, re-dispersibility after settling, and viscosity stability during cutting/slicing operations, aqueous cutting liquid usable for the aqueous cutting agent, and a cutting/slicing method excellent in cutting performance, cooling performance, cleanability and the like of the work material on cutting/slicing hard and brittle material by using the cutting agent.

After earnestly studying to develop a cutting agent which solves the foregoing problems, the present inventors found out that the object could be achieved through an aqueous cutting agent comprising the abrasive grain dispersed in a specified aqueous solution of cationic water-soluble resin, and completed the present invention on the basis of these findings.

More specifically, the present invention provides an aqueous cutting liquid (first embodiment of the present invention) which comprises a cationic water-soluble resin having an amine value of 20 to 200 mgKOH/g, and at least one rheology control agent selected from the group consisting of an inorganic bentonite, an organic bentonite, and an aqueous silica sol, wherein the content of nonvolatile matter of the rheology control agent is 0.1 to 30 percent by weight of the amount of the nonvolatile matter of the cationic water-soluble resin.

Also, the present invention provides an aqueous cutting liquid (second embodiment of the present invention) which comprises a cationic water-soluble resin having a total amine value of 50 to 200 mgKOH/g, containing a tertiary amino group and a quaternary ammonium salt-containing group, and at least one rheology control agent selected from the group consisting of an inorganic bentonite, an organic bentonite and an aqueous silica sol, wherein the content of the nonvolatile matter of the rheology control agent is 0.1 to 30 percent by weight of the amount of the nonvolatile matter of the cationic water-soluble resin.

Also, the present invention provides an aqueous cutting liquid (third embodiment of the present invention) which comprises an aqueous silica sol with an average particle diameter of 100 nm or less, and a cationic water-soluble resin having a total amine value of 50 to 200 mgKOH/g, containing a tertiary amino group and a quaternary ammonium salt-containing group, wherein the content of the nonvolatile matter of the aqueous silica sol is 0.1 to 30 percent by weight of the amount of the nonvolatile matter of the cationic water-soluble resin.

Also, the present invention provides an aqueous cutting liquid (fourth embodiment of the present invention) in which the cationic water-soluble resin specified in the aqueous cutting liquid of the foregoing third embodiment of the present invention contains 20 to 80 percent by weight of the structural unit represented by the formula (1):

(1)

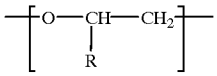

wherein R represents a hydrogen atom, a methyl group or an ethyl group.

Also, the present invention provides an aqueous cutting agent (fifth embodiment of the present invention) which comprises a cationic water-soluble resin having an amine value of 20 to 200 mgKOH/g and an abrasive grain, wherein the content of the abrasive grain is 100 to 1000 percent by weight of the amount of the nonvolatile matter of the cationic water-soluble resin.

Also, the present invention provides an aqueous cutting agent (sixth embodiment of the present invention) which comprises an aqueous cutting liquid specified in any one of the foregoing first to fourth embodiments according to the present invention and an abrasive grain, wherein the content of the abrasive grain is 100 to 1000 percent by weight of the amount of the nonvolatile matter of the aqueous cutting liquid.

Further, the present invention provides a method for cutting (seventh embodiment of the present invention) hard and brittle materials which comprises cutting the hard and brittle material with a cutting device by using the foregoing aqueous cutting agent.

BRIEF DESCRIPTION OF THE DRAWING

FIG. 1 shows an example of multi-wire sawing device mechanism of a cutting device.

PREFERRED MODE FOR CARRYING OUT THE INVENTION

Hereinafter, the detailed description will be made of the present invention.

The amine value of the cationic water-soluble resin used in the aqueous cutting liquid according to the first embodiment of the present invention is within a range of 20 to 200 mgKOH/g, preferably 25 to 150 mgKOH/g. When the amine value of the cationic water-soluble resin is less than 20 mgKOH/g, it becomes insufficient in water solubility, and the dispersion stability of the abrasive grain decreases. Also, when the amine value of the cationic water-soluble resin is more than 200 mgKOH/g, the viscosity of the aqueous solution becomes too high, and the liquidity of the cutting agent becomes excessively basic.

Also, as a functional group contained in the foregoing cationic water-soluble resin, any form of the primary amino group, the secondary amino group, the tertiary amino group or the quaternary ammonium base can be used, and the form of the salt neutralized by an acidic constituent can be used.

Examples of the foregoing cationic water-soluble resin include, for example, the following resin:

(1) Homopolymer or copolymer of a basic nitrogen atom-containing vinyl monomer, its salt, or its quaternary ammonium salt.

(2) Polycondensate of dicarboxylic acid and a polyethylene polyamine or a dipolyoxyethylene alkyl amine, its salt or its quaternary ammonium salt.

(3) Polymer of a dihaloalkane and a polyalkylene polyamine.

(4) Polyaddition product of a diepoxide and a secondary amine, its salt or quaternary ammonium salt.

(5) Polyaddition product of a diisocyanate and a diamine, its salt or its quaternary ammonium salt.

As the foregoing cationic water-soluble resin, resin prepared by synthesizing by various techniques other than the foregoing or the articles on the market can be all used.

Examples of the basic nitrogen atom-containing vinyl monomer in the resin (1) include acrylic acid derivatives such as N,N-dimethylaminoethyl acrylate, N,N-diethylaminoethyl acrylate; methacrylic acid derivatives such as N,N-dimethylaminoethyl methacrylate, N,N-diethylaminoethyl methacrylate; acrylamide derivatives such as N,N-dimethylaminopropyl acrylamide and N,N-dimethylaminopropyl acrylamide; methacrylamide derivatives such as N,N-dimethylaminopropyl methacrylamide and N,N-dimethylaminopropyl methacrylamide; olefin derivatives such as N,N-dimethylaminomethyl ethylene, N,N-diethylaminomethyl ethylene, N,N-dimethylaminomethyl propene, N,N-diethylaminomethyl propene; aminoalkyl vinyl ether derivatives such as N,N-dimethylaminoethyl vinyl ether and N,N-dimethylaminopropyl vinyl ether; vinyl pyridine derivatives such as 2-vinyl pyridine and 4-vinyl pyridine; vinyl imidazole derivatives such as 1-vinyl imidazole and 1-vinyl-2-methyl imidazole; vinyl quinoline derivatives such as 2-vinyl quinoline; vinyl piperidine derivatives such as N-methyl-3-vinyl quinoline; N,N-dialkylaminoalkyl group-substituted styrene or methylstyrene derivatives such as N,N-dimethylaminoethyl styrene.

Examples of the resin (2) include a polycondensate of an aliphatic dicarboxylic acid and polyethylene polyamine, and a polycondensate of an aliphatic dicarboxylic acid and dipolyoxyethylenealkylamine.

Examples of the resin (3) include a quaternary ammonium salt of a polycondensate of a dihaloalkane such as 1,2-dichloroethane, 1,2-dibromoethane and 1,3-dichloropropane, and a polyalkylene polyamine having two or more tertiary amino groups in the molecule, having an average molecular weight of 1,000 to 10,000,000.

An example of the cationic water-soluble resin (4) can be prepared by the following method.

The objective cationic water-soluble resin can be prepared by first using an excess amount of an epoxide to an amino group in an addition reaction of a diepoxide compound and a secondary amine compound to obtain a precursor polymer having a terminal epoxide, and then by converting the terminal epoxide to a quaternary ammonium salt with a tertiary amine and a monocarboxylic acid.

The cationic water-soluble resin contains preferably 20 to 80 percent by weight of a structural unit represented by the formula (1) in the resin.

(1)

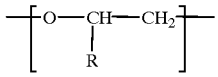

wherein R represents a hydrogen atom, a methyl group or an ethyl group.

The numbers of the structural unit are preferably in the range of 1 to 20. The structural unit has both effects that water-solubility and water-holding property of the resin increase.

Examples of the diepoxide used in the above-mentioned preparation method include, for example, a bisphenol A type epoxy resin and a bisphenol F type epoxy resin. The articles on the market include Epicoat #828, Epicoat #834 and Epicoat #1001 (all commercial names, produced by Yuka Shell Epoxy Co.).

Examples of the diepoxide having the structural unit represented by formula (1) include, for example, a polyalkylene glycol diglycidyl ether prepared by reacting an ethylene oxide adduct, a propylene oxide adduct or a butylene oxide adduct of a diol or diphenol with epichlorohydrin. The articles on the market include, for example, Epototo PG-207 (commercial name, produced by Tohto Kasei Co., Ltd.).

Examples of the secondary amine compound used in the addition reaction of the diepoxide include, for example, monomethyl amine, monoethyl amine, monoethanol amine, 2-aminopropanol and diglycol amine.

Examples of the tertiary amine used for converting the terminal epoxide of the precursor polymer prepared by the addition reaction of a diepoxide compound and a secondary amine to a quaternary ammonium salt, include, for example, triethyl amine, dimethylethanol amine, monomethyldiethanol amine and triethanol amine. Examples of the monocarboxylic acid used in the conversion include, for example, formic acid, acetic acid and lactic acid.

The tertiary amino group in the cationic water-soluble resin can be used by neutralizing with the above-mentioned organic acid, as required.

Examples of the diisocyanate in the above-mentioned (5) include isocyanate group-containing compounds such as p-phenylene diisocyanate, biphenyl diisocyanate, tolylene diisocyanate, 3,3'-dimethyl-4,4'-biphenylene diisocyanate, 1,4-tetramethylene diisocyanate, hexamethylene diisocyanate, 2,2,4-trimethylhexane-1,6-diisocyanate, methylenebis(phenyl isocyanate), lysinemethyl ester diisocyanate, bis(isocyanate ethyl)fumarate, isophorone diisocyanate, methylcyclohexyl diisocyanate and 2-isocyanate ethyl-2,6-diisocyanate hexanoate; and biuret derivatives and isocyanurate derivatives of these diisocyanates; and adduct compounds of these isocyanates and polyols; and also, blocked isocyanate group-containing compounds which are blocked derivatives of these isocyanate group-containing compounds with various blocking agents.

Examples of the diamine in the above-mentioned (5) include diamines represented by $NH_2(CH_2)_nNH_2$ (wherein n is 2 or more) such as ethylene diamine, propylene diamine, tetramethylene diamine, pentamethylene diamine, hexamethylene diamine, heptamethylene diamine, octamethylene diamine; aromatic diamines such as m-xylene diamine, m-toluidine diamine, p-phenylene diamine and diaminophenylmethane; and diamines of cyclic ring compounds, heterocyclic compounds or various oligomers. The structure of the other portion of the diamine is not particularly limited.

The articles on the market of the cationic water-soluble resin used in the first embodiment of the present invention include Disperbyk 184 (commercial names, produced by BYK-Chemie Co., Ltd., nonvolatile matter: 52 percent by weight, amine value of nonvolatile matter: 27 mgKOH/g) and EFKA polymer 450 (commercial names, produced by EFKA Chemicals Co., Ltd., nonvolatile matter: 50 percent by weight, amine value of nonvolatile matter: 45 mgKOH/g).

In this respect, examples of the salt in the resin of the foregoing (1) to (5) include salts of various acids such as inorganic acids and organic acids.

The cationic water-soluble resin used in the first embodiment of the present invention is diluted with water for agitating and mixing, and is used in the form of an aqueous solution. At this time, those which are usually used as water can be all used, and include, for example, city water, industrial water and pure water.

The cationic water-soluble resin having a total amine value of 50 to 200 mgKOH/g, containing a tertiary amino group and a quaternary ammonium salt-containing group, which is used in the second and third embodiments of the present invention, includes the same as the resin explained as one example of the cationic water-soluble resin of the foregoing (4).

In the present invention, the concentration of the nonvolatile matter of the cationic water-soluble resin in the aqueous solution of the foregoing cationic water-soluble resin is determined in consideration of the viscosity of the cutting agent, which is the end product, and the settling stability of the abrasive grain component, and is usually 5 to 70 percent by weight, preferably 10 to 60 percent by weight, or particularly preferably 20 to 40 percent by weight of the sum total of the foregoing cationic water-soluble resin and the water.

For the rheology control agent used in the first and second embodiments of the present invention, at least one is selected from an inorganic bentonite, an organic bentonite and an aqueous silica sol. Examples of the inorganic bentonite include sodium bentonite and calcium bentonite, and examples of the organic bentonite include bentonite surface-treated with cationic organic treating agent, for example, Benton 34 and Benton SD-2 (both produced by RHEOX INC.). As the bentonite, the inorganic bentonite is preferable.

The average particle diameter of the aqueous silica sol is preferably 100 nm or less, or more preferably 10 to 50 nm. When the average particle diameter of the aqueous silica sol is more than 100 nm, it is not preferable because the thixotropy imparting effect is low.

The aqueous silica sol generally can be obtained by decomposing silica tetrahalide in water or by hydrolyzing sodium silicate with acid. The articles on the market can, for example, be Snowtex-C, Snowtex-N, Snowtex-O (all commercial names, produced by Nissan Chemical Industries Co., Ltd.) and the like.

In the first and second embodiments of the present invention, the content of the nonvolatile matter of the rheology control agent is 0.1 to 30 percent by weight, preferably 0.2 to 20 percent by weight of the amount of the nonvolatile matter of the cationic water-soluble resin. When the content of the nonvolatile matter of the rheology control agent is less than 0.1 percent by weight, the thixotropy imparting effect is low, and when it is more than 30 percent by weight, it is not preferable because it becomes excessively thixotropic and the pumping properties are also impaired.

The aqueous silica sol with an average particle diameter of 100 nm or less which is used in the third embodiment of the present invention can be any of the aqueous silica sols specified in the rheology control agent used in the first and second embodiments of the present invention.

In the aqueous cutting liquid according to the third embodiment of the present invention, the content of the nonvolatile matter of the aqueous silica sol is 0.1 to 30 percent by weight of the amount of the nonvolatile matter of the cationic water-soluble resin, preferably 0.2 to 20 percent by weight. When the content of the nonvolatile matter of the aqueous silica sol is less than 1 percent by weight, the thixotropy imparting effect is low, and when 30 percent by weight is exceeded, it is not preferable because it becomes excessively thixotropic, and the pumping properties are also impaired.

The foregoing aqueous cutting liquid can be obtained by mixing and agitating the foregoing two components with water. As water for diluting, deionized water is preferably used.

The content of the water in the foregoing aqueous cutting liquid is not particularly limited, but can be usually 30 to 80 percent by weight.

Also, the foregoing aqueous cutting liquid can be caused to contain the foregoing various addition agents as required.

The aqueous cutting agent according to the fifth embodiment of the present invention contains cationic water-soluble resin having an amine value within a range of 20 to 200 mgKOH/g, and abrasive grain of a predetermined content with respect to the nonvolatile matter of the cationic water-soluble resin.

The cationic water-soluble resin having an amine value within a range of 20 to 200 mgKOH/g can be the same as the foregoing resins.

As regards the abrasive grain used for the aqueous cutting agent according to the present invention, there is no particular restriction, but various abrasive grains can be utilized. Examples of the abrasive grain include silicon carbide (SiC), aluminumoxide ($Al_2O_3$), silicondioxide ($SiO_2$), cesium dioxide ($CeO_2$), boron nitride (BN) and diamond. The average grain size of the abrasive grain is usually 40 $\mu$m or less, preferably 1 to 30 $\mu$m, or particularly preferably 10 to 25 $\mu$m. When the average grain size of the abrasive grain is more than 40 $\mu$m, their settling speed tends to become quicker.

The content of the foregoing abrasive grain is 100 to 1000 percent by weight, preferably within a range of 200 to 800 percent by weight, or particularly preferably 300 to 700 percent by weight of the amount of the nonvolatile matter of the cationic water-soluble resin.

When the content of the foregoing abrasive grain is less than 100 percent by weight, the amount of abrasive grain in the cutting agent is too small, and it takes many hours to cut. When the content is more than 1000 percent by weight, the settling stability of the abrasive grain is impaired.

The aqueous cutting agent according to the sixth embodiment of the present invention comprises an abrasive grain in any cutting liquid of the foregoing first to fourth embodiments of the present invention.

As regards the abrasive grain, the same ones as the foregoing are used. Also, the content of abrasive grain is the same as that of abrasive grain in the fifth embodiment of the present invention.

Also, the aqueous cutting agent according to the present invention can be caused to comprise, as required, various addition agents such as organic solvent such as alcohols, ethers and esters, a macromolecular dispersion agent such as polyalkylene glycol and a wetting agent, an antifoaming agent of mineral oil system or silicone system, and a rust-proof ancillary agent such as benzotriazole.

As regards work material in the method for cutting hard and brittle material according to the present invention, there is no particular restriction, but all hard and brittle material can be used as a target object. Preferred embodiments of hard and brittle material include ingots of silicon single crystal and polycrystal, rock crystal, ceramic, compound semiconductor and glass. The ingot is particularly preferable.

Also, as a cutting device used in the method for cutting hard and brittle material according to the present invention, all normal cutting devices can be used. Examples of preferred cutting devices include a wire sawing device, a band saw, a multi-wire sawing device and a multi-band saw which are obtained by multiplexing the wire sawing device and the band saw respectively, and a cutting device using outer peripheral blades or inner peripheral blades.

In the method for cutting hard and brittle material according to the present invention, the cutting is meant to include cutting and slicing.

Next, the description will be made of a concrete example of the method for cutting hard and brittle material according to the present invention.

A case where a multi-wire sawing device is used as the cutting device, using an ingot of single crystal silicon, which is hard and brittle material as work material, is exemplified and the cutting method will be described.

FIG. 1 shows an embodiment of the mechanism of a multi-wire sawing device. By pushing up an ingot fixed on the table in the direction that pushes up the table, the ingot is pressed against the wire. The wire diameter is not particularly limited, but is usually 0.05 to 0.25 mm.

The wire is wound around a multi-grooved guide roller many times, constant tension is applied to the wire, and used by reciprocating by a driving motor. The wire is caused to reciprocate by a constant length, and thereafter, is wound up at a constant length whereby new wire is sequentially supplied, and the used wire worn by the cutting is wound up.

The wire is supported by the multi-grooved guide roller, is caused to come into contact with the ingot while an adequate cutting load is being imparted thereto, and a cutting agent having abrasive grain dispersed therein is supplied between the wire and the ingot to thereby shave and cut the ingot.

EXAMPLES

Hereinafter, the description will be made of examples embodying the present invention. In this respect, the present invention is not limited to the following concrete examples, but is applicable to examples which are changed within the scope of the present invention.

Also, the cutting agent for the wire sawing device was evaluated by the following method.

Cleanability test: This test evaluates the cleanability using water.

(a) Place 300 ml of the cutting agent prepared in the example in a 300 ml beaker, and adjust the temperature to 25±0.5° C.

(b) Dip a single crystal silicon wafer square plate in the cutting agent for one minute.

(c) Slowly pull up the single crystal silicon wafer square plate, and keep it intact at room temperature for 24 hours.

(d) After a lapse of 24 hours, weigh the cutting agent adhered to the single crystal silicon wafer square plate, and regard it as the weight before washing.

(e) Immerse it in 300 ml of hot water at 30° C., and wash for 15 seconds by shaking it with a ultrasonic generator.

(f) After drying the test piece, weigh the cutting agent adhered to the single crystal silicon wafer square plate, and regard it as the weight after washing.

(g) Determine the washing rate on the basis of the following: (Weight before washing−weight after washing)/weight before washing×100 The respective evaluations were conducted in accordance with the following criteria:

◎: 95% or more

○: 80% or more to less than 95%

Δ: 60% or more to less than 80%

×: Less than 60%

Dispersion stability test: This test evaluates the dispersion stability of abrasive grains.

(a) Adjust the temperature of the cutting agent prepared in the example to 25±0.5° C.

(b) Place slurry in a 100 ml graduated measuring cylinder correctly and keep it intact at room temperature.

(c) Read the time when all has settled down.

The respective evaluations were conducted in accordance with the following criteria:

◎: 8 hours or more to less than 24 hours

○: 6 hours or more to less than 8 hours

Δ: 4 hours or more to less than 6 hours

×: Less than 4 hours

Wafer cutting performance test: This test actually performs cutting work using a wire sawing device, and evaluates the cutting performance of the wafer cut.

(a) Wire sawing device: Multi-wire saw E250E (wire diameter: 180 μm) manufactured by HCT Shaping Systems SA.

(b) Table speed: 380 μm/min (c) Target wafer thickness: 820 μm (d) Ingot diameter: 8 inch (e) Ingot length: 60 to 130 mm (f) Evaluation items: The warp was measured using a machine Ultra Gage 9500 manufactured by Japan ADE Ltd. The measurement was conducted for ten wafers at 5 points per wafer, and the average value was regarded as the measured result.

The respective evaluations for warp were conducted in accordance with the following criteria:

◎: 0 μm or more to less than 10 μm

○: 10 μm or more to less than 20 μm

Δ: 20 μm or more to less than 30 μm

×: 30 μm and more

Re-dispersibility test: This test evaluates the re-dispersibility of the abrasive grain.

(a) Adjust the temperature of the cutting agent prepared in the example to 25±1° C.

(b) Place slurry in a 300 ml tall beaker to adjust to the room temperature.

(c) After all settled down, slowly agitate the upper portion of the liquid with an agitating blade to read the time until the deposit at the bottom disappears.

The respective evaluations were conducted in accordance with the following criteria:

◎: Less than 5 minutes

○: 5 minutes or more to less than 10 minutes

Δ: 10 minutes or more to less than 15 minutes

×: 15 minutes and more

Viscosity stability test (1): This test evaluates the viscosity stability using shearing force.

(a) Adjust the temperature of the cutting agent prepared in the example to 25±1° C.

(b) Place slurry in a 300 ml tall beaker to adjust to the room temperature.

(c) Using a homogenizer, agitate at 10,000 rpm for two hours, adjust to 25° C., and determine viscosity change before and after the agitation to see the influence due to the shearing force.

(d) Homogenizer: manufactured by Tokushu Kikakogyo Co., Ltd. Model MARKII2.5

The respective evaluations were conducted in accordance with the following criteria: The numerical values show the viscosity change rate.

◎: Less than 10%

○: 10% or more to less than 20%

Δ: 20% or more to less than 30%

×: 30% and more

Cooling performance test: This test measures, using a radiation temperature indicator, the temperature of the wafer in the machined portion during cutting in the foregoing wafer cutting performance test in order to evaluate the cooling performance during the cutting.

The respective evaluations were conducted in accordance with the following criteria:

◎: Less than 35° C.

○: 35° C. or more to less than 40° C.

Δ: 40° C. or more viscosity stability test (2): This test measures the slurry viscosity before and after cutting in the foregoing wafer cutting performance test in order to evaluate the viscosity stability during cutting work.

(a) Measure slurry viscosity before and after cutting respectively.

(b) Determine the amount of viscosity change to investigate the influence due to change in water content and high shearing force during cutting work.

The respective evaluations were conducted in accordance with the following criteria. The numerical values show the amounts of viscosity change.

◎: Less than ±100 cp

Δ: ±100 cp or more to less than ±300 cp

×: ±300 cp and more

Machinability test: This test measures the load factor of the equipment power during cutting in the foregoing wafer cutting performance test in order to evaluate the shearability during cutting work.

The respective evaluations were conducted in accordance with the following criteria. The numerical values show the power load factor.

◎: Less than 25%

○: 25% or more to less than 30%

Δ: 30% or more

Examples 1 to 6

In examples 1 to 6, so as to have the composition ratio (weight unit) shown in Table 1, a mixture of Disperbig 184 and water, or a mixture of these goods and bentonite is used as cutting liquid, and silicon carbide (produced by Fujimi Incorporated, commercial name: GC#600, average grain size: 20 to 25 μm) is used for the abrasive grain, and an aqueous cutting agent was obtained by agitating and mixing both. Using this aqueous cutting agent, and using an ingot of single crystal silicon as the work material, the tests were conducted for each evaluation item. The results are shown in Table 2.

Comparative Examples 1 to 3

Using a non-aqueous cutting agent with mineral oil as the base oil in comparative example 1, a glycol cutting agent in comparative example 2, and a surface-active agent-series of cutting agent in comparative example 3 respectively, and using an ingot of single crystal silicon as the work material, the tests were conducted for each evaluation item. The results are shown in Table 2.

TABLE 1

| Composition component | | | Example 1 | 2 | 3 | 4 | 5 | 6 | Comparative example 1 | 2 | 3 |
|---|---|---|---|---|---|---|---|---|---|---|---|
| Cutting agent | Cutting liquid | Disperbyk 184 (Percent by weight in cutting liquid) | 30 | 50 | 70 | 80 | 90 | 70 | — | — | — |
| | | Water (Percent by weight in cutting liquid) | 70 | 50 | 30 | 20 | 10 | 29 | — | — | — |
| | | Inorganic bentonite | — | — | — | — | — | 1 | — | — | — |
| | Abrasive grain | Content of silicon carbide (Percent by weight with respect to cutting liquid) | 120 | 120 | 100 | 100 | 120 | 100 | 120 | 120 | 120 |
| | | Content of silicon carbide (Percent by weight of nonvolatile matter of cationic water-soluble resin) | 769 | 462 | 275 | 240 | 256 | 275 | — | — | — |
| | Non-aqueous cutting agent | Mineral oil | — | — | — | — | — | — | 87 | — | — |
| | | Methyl oleate | — | — | — | — | — | — | 11 | — | — |
| | | Petroleum sulfonic acid calcium | — | — | — | — | — | — | 2 | — | — |
| | Glycol cutting agent | Glycols | — | — | — | — | — | — | — | 89 | — |
| | | Water | — | — | — | — | — | — | — | 10 | — |
| | | Bentonite | — | — | — | — | — | — | — | 1 | — |
| | Surface-active agent-system cutting agent | Surface-active agents | — | — | — | — | — | — | — | — | 48 |
| | | Water | — | — | — | — | — | — | — | — | 50 |
| | | Bentonite | — | — | — | — | — | — | — | — | 2 |

TABLE 2

| Evaluation item | Example 1 | 2 | 3 | 4 | 5 | 6 | Comparative example 1 | 2 | 3 |
|---|---|---|---|---|---|---|---|---|---|
| Cleanability | ◎ | ◎ | ○ | ○ | ○ | ○ | x | ○ | ○ |
| Dispersion stability | ○ | ◎ | ◎ | ◎ | ◎ | ◎ | ◎ | Δ | Δ |
| Wafer cutting performance | ○ | ◎ | ○ | ○ | ○ | ◎ | ◎ | Δ | Δ |
| Re-dispersibility | ○ | ◎ | ◎ | ◎ | ◎ | ◎ | ◎ | Δ | Δ |
| Viscosity stability (1) | ○ | ◎ | ◎ | ◎ | ◎ | ◎ | ◎ | ○ | ○ |
| Cooling performance | ◎ | ◎ | ○ | ○ | Δ | ○ | x | Δ | ○ |
| Viscosity stability (2) | ◎ | ◎ | ◎ | Δ | Δ | ◎ | ◎ | ◎ | x |
| Machinability | ◎ | ◎ | ○ | ○ | ○ | ○ | Δ | Δ | ○ |

As can be seen from Table 2, according to the aqueous cutting agent of the present invention, the cleanability can be improved as compared with the conventional non-aqueous or aqueous cutting agent. Also, since the dispersion stability of the abrasive grain is also high and the abrasive grain settle down slowly, the viscosity stability during the cutting operation is also high. Therefore, the warp value indicating the cutting performance also could be restricted to 20 $\mu$m or less.

Preparation Example 1

(Preparation of cationic water-soluble resin A-1)

Into a reaction vessel equipped with a thermometer, a stirrer, a reflux condenser and a nitrogen gas introduction tube, 636.7 parts by weight of Epicoat #828 (commercial name, produced by Yuka Shell Epoxy Co.) and 142.9 parts by weight of diglycol amine were charged under a nitrogen gas stream and the mixture was heated for 1.5 hours to increase the temperature to 120° C. and reacted at the same temperature for an additional 1 hour. And then, the reaction temperature was decreased to 80° C. and the mixture obtained by premixing 72.9 parts by weight of dimethyl ethanolamine and 147.5 parts by weight of 50 percent by weight lactic acid aqueous solution was added into the reaction product. The mixture was reacted for 2 hours to obtain cationic water-soluble resin A-1 having a tertiary amine value of 82.5 mgKOH/g, a quaternary ammonium salt value of 49.7 mgKOH/g and a total amine value of 132 mgKOH/g per the nonvolatile matter of the resin. The nonvolatile matter of the cationic water-soluble resin was 92.6 percent by weight. The content of the structural unit represented by formula (1) in cationic water-soluble resin A-1 was 11 percent by weight.

Preparation Example 2

(Preparation of cationic water-soluble resin A-2)

Into the same reaction vessel as Preparation Example 1, 757.3 parts by weight of Epototo PG-207 (commercial name, produced by Tohto Kasei Co., Ltd.) and 97.5 parts by weight of diglycol amine were charged under a nitrogen gas stream and the mixture was heated for 1.5 hours to increase the temperature to 120° C. and reacted at the same temperature for an additional 1 hour. And then, the reaction temperature was decreased to 80° C. and the mixture obtained by premixing 48.1 parts by weight of dimethyl ethanolamine and 97.1 parts by weight of 50 percent by weight lactic acid aqueous solution was added into the reaction product. The mixture was reacted for 2 hours to obtain cationic water-soluble resin A-2 having a tertiary amine value of 54.8 mgKOH/g, a quaternary ammonium salt value of 31.9 mgKOH/g and a total amine value of 86.7 mgKOH/g per the nonvolatile matter of the resin. The nonvolatile matter of the cationic water-soluble resin was 95.2 percent by weight. The content of the structural unit represented by formula (1) in cationic water-soluble resin A-2 was 57 percent by weight.

Example 7

To 24.83 parts by weight of the cationic water-soluble resin A-1 prepared in Preparation Example 1, 62.57 parts by weight of deionized water and 12.3 parts by weight of Snowtex-O (commercial name, produced by Nissan Chemical Industries Co., Ltd.) were added slowly under stirring and then 0.3 part by weight of a defoaming agent (SN-defoamer325, commercial name, produced by San Nopco Co.) was added to the mixture and the mixture was stirred for 1 hour to obtain an aqueous cutting liquid.

The weight ratio of the nonvolatile matter of the aqueous silica sol and the solid matter of the cationic water-soluble resin in the aqueous cutting liquid was 15:85.

Examples 8 to 10

The aqueous cutting liquids of Examples 8 to 10 were obtained by using the cationic water-soluble resin A-2 prepared in Preparation Example 2 and carrying out according to the formulation shown in Table 3 and the procedure of Example 7.

TABLE 3

| Example | 7 | 8 | 9 | 10 |
|---|---|---|---|---|
| Formulation ratio (parts by weight) | | | | |
| Cationic water-soluble resin A-1 | 24.83 | — | — | — |
| Cationic water-soluble resin A-2 | — | 27.31 | 26.26 | 23.63 |
| Deionized water | 62.57 | 63.64 | 57.59 | 53.34 |
| Snowtex-O *1) | 12.30 | 8.75 | 15.85 | 22.73 |
| Defoaming agent *2) | 0.30 | 0.30 | 0.30 | 0.30 |
| Sum | 100.00 | 100.00 | 100.00 | 100.00 |
| Weight ratio of nonvolatile matter of aqueous silica sol/cationic water-soluble resin | 15/85 | 10/90 | 17/83 | 25/75 |

*1) commercial name, produced by Nissan Chemical Co., Ltd., aqueous silica sol having a nonvolatile matter of 33 percent by weight. Average particle diameter; 20 nm
*2) SN-Defoamer 325, commercial name, produced by San Nopco Co.

Example 11

Into 100 parts by weight of the aqueous cutting liquid prepared in Example 8, 100 parts by weight of an abrasive grain (SiC abrasive grain GC#600, average grain size of the abrasive grain: 20 to 25 $\mu$m) was mixed and dispersed to obtain cutting slurry-11. Tests were carried out about each Evaluation item by using a single crystal ingot as a worked material. The results are shown in Table 4.

Examples 12 to 14

Abrasive grains were mixed into the aqueous cutting liquids prepared in Examples 7, 9 and 10 according to the same method of Example 11 to obtain aqueous cutting agents 12 to 14. Tests were carried out about each Evaluation item by using a single crystal ingot as a worked material. The results are shown in Table 4.

TABLE 4

| Evaluation item | Example 11 | 12 | 13 | 14 |
|---|---|---|---|---|
| Cleanability | ○ | ◎ | ○ | ○ |
| Dispersion stability | ◎ | ○ | ◎ | ◎ |
| Wafer cutting performance | ◎ | ○ | ◎ | ○ |

TABLE 4-continued

| Evaluation item | Example 11 | 12 | 13 | 14 |
|---|---|---|---|---|
| Re-dispersibility | ◎ | ○ | ○ | ◎ |
| Viscosity stability (1) | ◎ | ◎ | ○ | ○ |
| Cooling performance | ○ | ◎ | ○ | ○ |
| Viscosity stability (2) | ◎ | ○ | ○ | Δ |
| Machinability | ○ | ○ | ○ | ○ |

ADVANTAGES OF THE INVENTION AND INDUSTRIAL APPLICABILITY

The aqueous cutting agent according to the present invention prevents the abrasive grains from settling down, is excellent in dispersion of abrasive grains, and is capable of stably holding abrasive grains in the aqueous cutting agent. Also, it does not agglomerate and solidify hard even if the abrasive grains settle down, but the abrasive grain after the settling easily re-disperse. Thus, the cutting agent according to the present invention has high viscosity stability during a cutting/slicing operation, stable abrasive grain density, and it uniformly adheres to a cutting tool of the cutting device, for example, wire. Therefore, the cut/machined surface has small swells, and the hard and brittle material can be cut/machined with excellent cutting performance. Also, the aqueous cutting liquid according to the present invention is capable of being employed for the aqueous cutting agent according to the present invention. Also, when work material is cut/machined using a specified cutting agent according to the present invention, the cutting agent can be simply removed by water washing even if no organic solvent is used on cleaning the work material, the operator and the equipment after the use. Further, on scrapping the cutting agent according to the present invention, cleaning drainage, in which the abrasive grains have been removed after the cutting agent is diluted to 5,000 to 10,000 times or more, has low toxicity, and therefore it can be also scrapped as it is. By water washing the cutting liquid adhering to the abrasive grain thus separated, the cutting liquid can be simply removed, and it is also possible to re-use the abrasive grain separated.

What is claimed is:

1. An aqueous cutting liquid which comprises a cationic water-soluble resin having an amine value of 20 to 200 mgKOH/g, and at least one rheology control agent selected from the group consisting of an inorganic bentonite, an organic bentonite and an aqueous silica sol, wherein the content of a nonvolatile matter of the rheology control agent is 0.1 to 30 percent by weight of the amount of the nonvolatile matter of the cationic water-soluble resin.

2. An aqueous cutting liquid which comprises a cationic water-soluble resin having a total amine value of 50 to 200 mgKOH/g, containing a tertiary amino group and a quaternary ammonium salt-containing group, and at least one rheology control agent selected from the group consisting of an inorganic bentonite, an organic bentonite and an aqueous silica sol, wherein the content of a nonvolatile matter of the rheology control agent is 0.1 to 30 percent by weight of an the amount of the nonvolatile matter of the cationic water-soluble resin.

3. An aqueous cutting liquid which comprises an aqueous silica sol with an average particle diameter of 100 nm or less, and a cationic water-soluble resin having a total amine value of 50 to 200 mgKOH/g, containing a tertiary amino group and a quaternary ammonium salt-containing group, wherein the content of the nonvolatile matter of the aqueous silica sol is 0.1 to 30 percent by weight of the amount of the nonvolatile matter of the cationic water-soluble resin.

4. The aqueous cutting liquid as claimed in claim 3, wherein the cationic water-soluble resin specified in claim 3 contains 20 to 80 percent by weight of a structural unit represented by the formula (1):

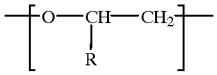

(1)

wherein R represents a hydrogen atom, a methyl group or an ethyl group.

5. An aqueous cutting agent which comprises a cationic water-soluble resin having an amine value of 20 to 200 mgKOH/g and an abrasive grain, wherein the content of the abrasive grain is 100 to 1000 percent by weight of the amount of the nonvolatile matter of the cationic water-soluble resin.

6. An aqueous cutting agent which comprises the aqueous cutting liquid specified in any one of claims 1 to 4, and an abrasive grain, wherein the content of the abrasive grain is 100 to 1000 percent by weight of the amount of the nonvolatile matter of the aqueous cutting liquid.

7. A method for cutting a hard and brittle material which comprises cutting the hard and brittle material by a cutting device using the aqueous cutting agent as claimed in claim 5.

8. A method for cutting a hard and brittle material which comprises cutting the hard and brittle material by a cutting device using the aqueous cutting agent as claimed in claim 6.

9. A method for cutting a hard and brittle material which comprises cutting the hard and brittle material by a cutting device using the aqueous cutting agent as claimed in claim 2.

10. A method for cutting a hard and brittle material which comprises cutting the hard and brittle material by a cutting device using the aqueous cutting agent as claimed in claim 3.

11. A method for cutting a hard and brittle material which comprises cutting the hard and brittle material by a cutting device using the aqueous cutting agent as claimed in claim 4.

* * * * *